US010297234B2

(12) United States Patent
Ekambaram et al.

(10) Patent No.: US 10,297,234 B2
(45) Date of Patent: May 21, 2019

(54) CURVED VIRTUAL DISPLAY SURFACE FOR DISPLAYING DIGITAL OBJECTS

(71) Applicant: INTERNATIONAL BUSINESS MACHINES CORPORATION, Armonk, NY (US)

(72) Inventors: Vijay Ekambaram, Tamilnadu (IN); Sarbajit K. Rakshit, Kolkata (IN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/067,906

(22) Filed: Mar. 11, 2016

(65) Prior Publication Data

US 2017/0262961 A1 Sep. 14, 2017

(51) Int. Cl.
*G09G 3/00* (2006.01)
*G09G 5/34* (2006.01)

(52) U.S. Cl.
CPC ..... *G09G 5/346* (2013.01); *G09G 3/003* (2013.01)

(58) Field of Classification Search
CPC ..... G06F 1/1652
USPC ..... 345/666
See application file for complete search history.

(56) References Cited

U.S. PATENT DOCUMENTS 7,576,750 B2 8/2009 Eckhardt et al.
8,715,079 B1 * 5/2014 Loose ..... G07F 17/3211 463/30
8,958,026 B2 2/2015 Ark et al.
2001/0048377 A1 12/2001 Mochizuki et al.
2004/0025112 A1 2/2004 Chasen et al.
2006/0156228 A1 * 7/2006 Gallo ..... G06F 3/0481 715/202
2006/0274060 A1 * 12/2006 Ni ..... G06F 3/0482 345/419
2008/0062164 A1 * 3/2008 Bassi ..... H04N 9/3147 345/214
2009/0019401 A1 * 1/2009 Park ..... G06F 3/04883 715/841
2010/0056223 A1 * 3/2010 Choi ..... G06F 1/1601 455/566

(Continued)

FOREIGN PATENT DOCUMENTS

CN 10385457 6/2014
WO 2013136204 A1 9/2013
WO 2016052814 A1 4/2016

OTHER PUBLICATIONS

List of IBM Patents or Patent Application Treated as Related, Mar. 14, 2016.

(Continued)

*Primary Examiner* — Shivang I Patel
(74) *Attorney, Agent, or Firm* — Michael O'Keefe; Matthew M. Hulihan; Heslin Rothenberg Farley & Mesiti PC

(57) ABSTRACT

Establishing a curved virtual display surface on a physical display is provided. A process identifies dimensions of a digital object for display on a physical display of a computer system, the physical display including fixed display dimensions. Based on the identified dimensions of the digital object, the process establishes on the physical display a curved virtual display surface for displaying the digital object, and displays the digital object in the curved virtual display surface.

17 Claims, 11 Drawing Sheets

(56) References Cited

U.S. PATENT DOCUMENTS

| | | | | |
|---|---|---|---|---|
| 2010/0283727 | A1 | 11/2010 | Jiang et al. | |
| 2012/0075166 | A1 | 3/2012 | Marti et al. | |
| 2012/0235893 | A1* | 9/2012 | Phillips | G06F 3/012 345/156 |
| 2013/0222432 | A1 | 8/2013 | Arrasvuori et al. | |
| 2013/0329422 | A1 | 12/2013 | Park et al. | |
| 2014/0015402 | A1 | 1/2014 | Ahn et al. | |
| 2014/0101560 | A1 | 4/2014 | Kwak et al. | |
| 2014/0104244 | A1 | 4/2014 | Baldwin | |
| 2014/0320393 | A1 | 10/2014 | Modarres | |
| 2014/0354791 | A1 | 12/2014 | Lee et al. | |
| 2015/0049090 | A1 | 2/2015 | Kim et al. | |
| 2015/0227173 | A1 | 8/2015 | Hwang | |
| 2016/0154564 | A1* | 6/2016 | Chiang | G06F 3/04817 715/834 |
| 2016/0179230 | A1 | 6/2016 | Rider et al. | |
| 2016/0187745 | A1* | 6/2016 | Jin | G02F 1/134336 349/110 |

OTHER PUBLICATIONS

CinemaScope, Wikipedia, page modified Jan. 3, 2016, https://en.wikipedia.org/wiki/CinemaScope.

Anamorphic Format, Wikipedia, page modified Dec. 24, 2015, https://en.wikipedia.org/wiki/Anamorphic_format.

EL15: Why Were Old CRT TVs Curved?, reddit.com, last accessed Feb. 12, 2016, https://www.reddit.com/r/explainlikeimfive/comments/254nqy/eli5_why_were_old_crt_tvs.

Fisheye Lens, Wikipedia.com, site accessed Feb. 12, 2016, https://en.wikipedia.org/wiki/Fisheye_lens.

Technology . . . or magic? Samsung shows off video of transparent, flexible screen—with 3D so real it looks like you can touch it, Daily Mail, Dec. 7, 2011, http://www.dailymail.co.uk/sciencetechtarticle-2070741/Samsungs-transparent-flexible-screen-3D-real-looks-like-touch-it.html.

Dante D'Orazio, "Samsung Reveals a Wild Bendable TV Prototype and its Curved, 105-inch Ultra HD TV", Jan. 6, 2014, 4 pages.

John Archer, "Curved TVs: 6 Reasons You Should Buy One—and 6 More Why You Shouldn't", http://www.forbes.com/sites/johnarcher/2014/08/13/curved-tvs-6-reasons-you-should-buy-one-and-6-mor.

John Archer, "Curved TVs: The Pros and Cons", May 20, 2015, http://www.trustedreviews.com/opinions/curved-tvs-the-pros-and-cons.

Schulte-Pelkum et al. "Screen curvature does influence the perception of visually simulated ego-rotations", presented at VSS 2003, Sarasota, http://www.kyb.tuebingen.mpg.de/fileadmin/user_upload/files/publications/pdfs/pdf2024.pdf.

Aseem Girkar, "LG 4K Flexible Curved OLED TV Launched", GizCrunch, Jan. 7, 2014, http://gizcrunch.com/2014/01/lg-4k-flexible-curved-oled-tv-launched-ces-2014/.

"Electroactive polymers", Wikipedia, https://en.wikipedia.org/wiki/Electroactive_polymers.

Raghu Das, "Printed, Flexible and Organic Electronics Report", IDTechEx, http://www.idtechex.com/research/reports/electroactive-polymers-and-devices-2013-2018-forecasts-technologies-players-000347.asp.

"Electroactive Polymers", Technische Universitat Darmstadt, http://www.emk.tu-darmstadt.de/en/mems/research/electroactive-polymers/.

"Electroactive Polymer 'Artificial Muscle'", SRI International, http://www.sri.com/engage/products-solutions/epam.

"Modeling—Geometry Types (Refinements) (3D Animation Using Maya)", what-when-how, http://what-when-how.com/3d-animation-using-maya/modeling-geometry-types-refinements-3d-animation-using-maya/.

Schulte-Pelkum et al. "Screen curvature does influence the perception of visually simulated ego-rotations", presented at VSS 2003, Sarasota, http://www.researchgate.net/publication/216055702_Screen_curvaturedoes_influence_the_perception_of_visually_simulated_ego-rotations.

Office Action in U.S. Appl. No. 14/819,628 dated Jun. 30, 2017, pp. 1-32.

* cited by examiner

CURVED VIRTUAL DISPLAY SURFACE FOR DISPLAYING DIGITAL OBJECTS

BACKGROUND

Display devices have fixed physical dimensions, typically forming a rectangular display. Developments in display technology, especially mobile device displays, yields higher pixel density leading to improved resolution. By their nature, however, mobile devices are limited in size and therefore the physical dimensions of their displays are kept relatively small. Consequently, the height and/or other dimension(s) of large (pixel×pixel) digital content such as photographs, webpages, or videos is typically reduced, in order to fit the object on the mobile device display, while maintaining the original aspect ratio—that is, without stretching the digital object in one direction relative to other direction(s).

Under the above approach, the digital object is reduced proportionally in size until it fully fits to the length/height of physical display. Such a drastic change in the size of the object may be undesirable. However, it may be equally undesirable to incorporate a scrollbar to view the entire content, such as is the case when a panoramic image does not fit fully on the display.

SUMMARY

Shortcomings of the prior art are overcome and additional advantages are provided through the provision of a computer-implemented method that includes identifying dimensions of a digital object for display on a physical display of a computer system, the physical display including fixed display dimensions; based on the identified dimensions of the digital object, establishing on the physical display a curved virtual display surface for displaying the digital object; and displaying the digital object in the curved virtual display surface.

Further, a computer program product including a computer readable storage medium readable by a processor and storing instructions for execution by the processor is provided for performing a method that includes: identifying dimensions of a digital object for display on a physical display of a computer system, the physical display including fixed display dimensions; based on the identified dimensions of the digital object, establishing on the physical display a curved virtual display surface for displaying the digital object; and displaying the digital object in the curved virtual display surface.

Yet further, a computer system is provided that includes a memory and a processor in communications with the memory, wherein the computer system is configured to perform a method including: identifying dimensions of a digital object for display on a physical display of a computer system, the physical display including fixed display dimensions; based on the identified dimensions of the digital object, establishing on the physical display a curved virtual display surface for displaying the digital object; and displaying the digital object in the curved virtual display surface.

Additional features and advantages are realized through the concepts described herein.

BRIEF DESCRIPTION OF THE DRAWINGS

Aspects described herein are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Aspects described herein provide software-defined and implemented curved—concave or convex—virtual display surfaces/planes based on displayed digital object(s). Additional features provide alignment of the curvature of the virtual surface to a line of sight of a user and automatic correction when viewing angle changes. Additionally, convexity of the virtual display surface can be non-linear at distinct places of the surface, providing richness to the user in displaying the digital object and, if desired, counteracting the curvature effect to the digital object displayed on the curved virtual display surface.

In an example embodiment, when digital content or a digital object of that digital content is to be displayed, software installed on the device (mobile device, or more generally computer system) establishes on the physical display a curved virtual display plane or surface. The curved virtual display surface leverages a depth perspective imparted by the curvature to increase the length of the display surface for displaying the digital content or object. The curvature of the virtual display surface can be made dependent on dimension(s) of the digital object, such that the larger or longer the dimension of the digital object to fit on the physical display, the more drastic the curvature is to be for the curved virtual display surface. The content is thereby accommodated on the display device, i.e. in the curved virtual display surface, absent use or reliance on a scroll bar for scrolling to display the entire object. The curved virtual display surface provides an appearance resembling that of an actual curved display screen, except that the curved surface is established within a physical display area of a fixed size.

The fixed size may be smaller in at least one dimension than one or more dimensions of the curved virtual display surface.

The user may have the ability to manually adjust the curvature, shape, and/or orientation of the curved virtual display surface, for example to adjust the user's viewing perspective to the surface.

Figure 2A:
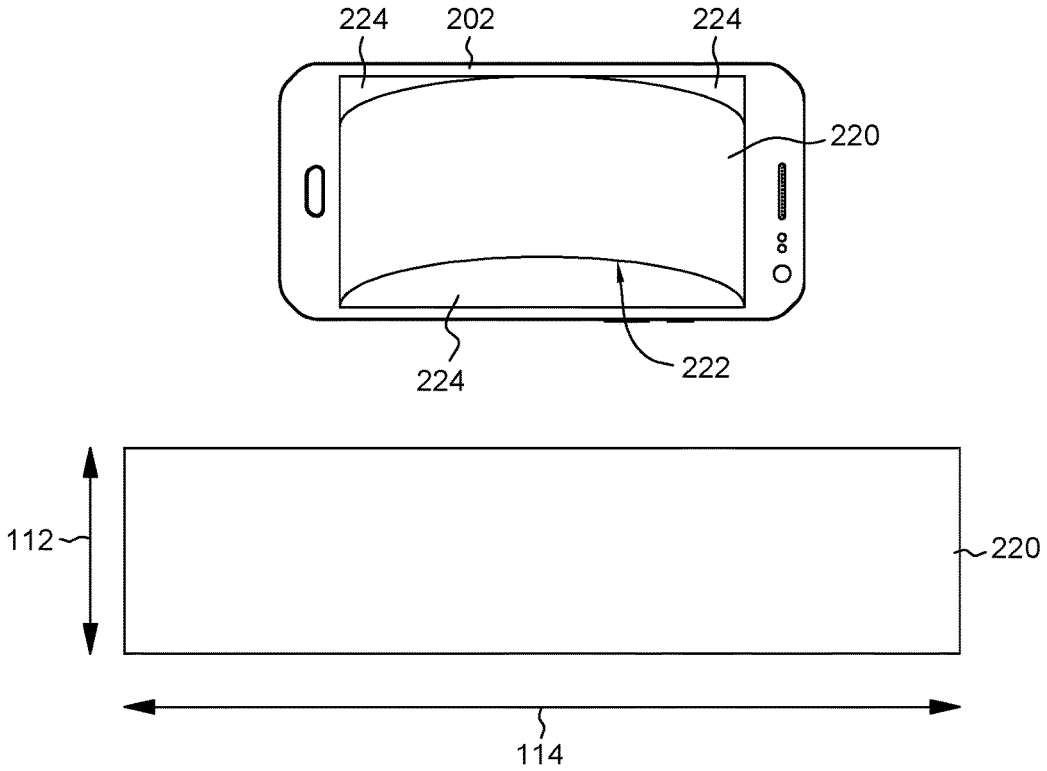
FIGS. 2A-2C depict an example of a curved virtual display surface established on a fixed-size physical display of a mobile device, in accordance with aspects described herein.

The curvature of the virtual display surface provides a varying level of depth/distance from the user's perspective across the digital object being displayed in the curved virtual display surface. For instance, if a concave display surface is provided as shown in FIG. 2A, the greatest depth of the digital object relative to the user's vantage point is in the middle of the object and the least depth is at the sides of the curved virtual display surface. According to aspects described herein, software can automatically apply adjustments, for instance to zoom level and/or font size, of portions of the digital object in order for the virtual curvature effect of the curved virtual display surface to be less apparent, and in some cases unnoticeable to the user. Software can also change the curvature profile of the virtual display surface. The relative distance of different points of the virtual display surface from the user's eye may remain constant to an extent possible after the device is moved in the vertical axis, and an entirety of the virtual display surface can be visible from the user's current viewpoint. This can help the software to appropriately adjust near-view and far-view areas of the digital object based on determining distances between those areas and the user's eyes. The dimension or font size of portion(s) of the digital object may be modified so that user will not have difficulty in reading/viewing areas of the object. The curvature of the display can also be adjusted based on the near-view and far-view calculations.

In some aspects, software can suggest a best or preferred orientation (horizontal or vertical) of the mobile device for displaying the digital object based on the dimensions of the digital object and the dimensions of the physical display of fixed dimensions. This orientation can be determined at least partially based on the individual user's historical viewing pattern of other digital content and/or other user's feedback regarding preferred or desired orientation. Based on the user rotating the mobile device to the suggested orientation, the curved virtual display surface can be established on the screen to enlarge the total effective display area.

Device(s) installed in the mobile device can track the relative angular positions among the facial plane of the user, a plane of the mobile device's physical display, and the eye direction (viewing direction) of the user. Example such devices include camera(s) and sensor(s) such as accelerometer(s). Based on the user's historical viewing pattern, in some examples, software installed in the mobile device can automatically learn the user's preferred viewing angle with respect to the physical display plane and the user's facial plane. If device's physical display plane or user's facial plane changes with respect to the user's viewing direction, then software installed in the mobile device can adjust, such as rotate about the polar axis and/or change the curvature of the curved virtual display surface. The rotation of the virtual display surface can be done in such a way that the change in angle observed can be automatically compensated-for by the rotation of the virtual display surface about its polar axis. This provides the user with the same virtual display orientation with respect to the user's eye focus direction as was used previously, prior to the observed change in the physical display plane or user's facial plane.

Figure 1A:
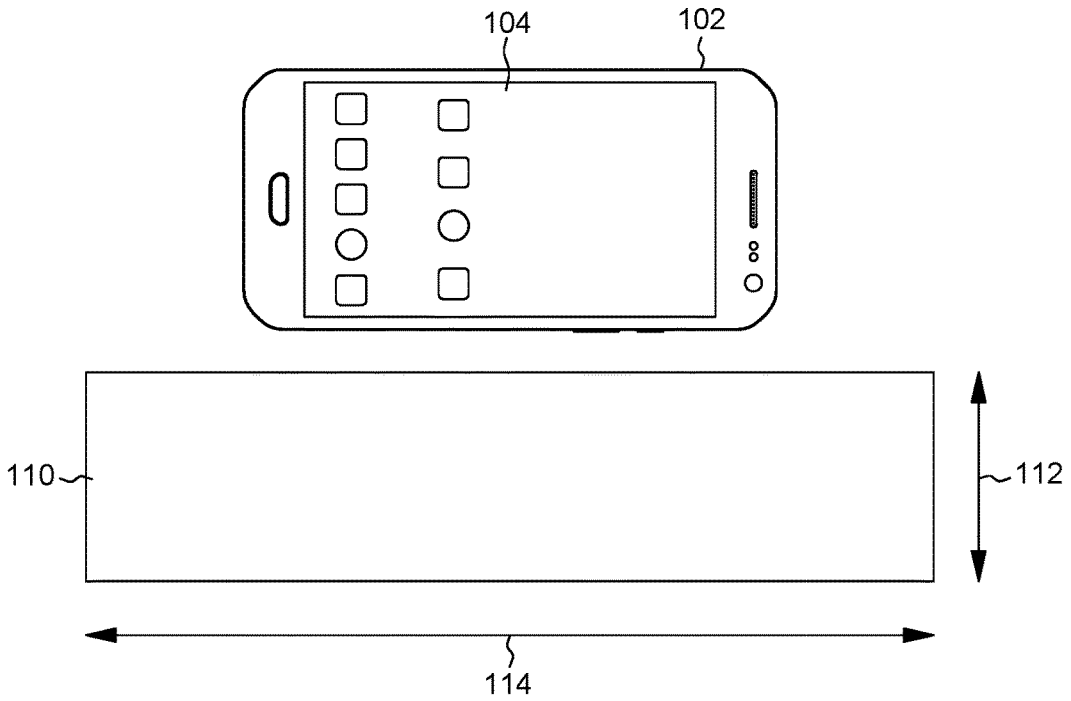
FIGS. 1A and 1B depict an example of proportionally shrinking a large digital object for display on a mobile device.
Figure 1B:
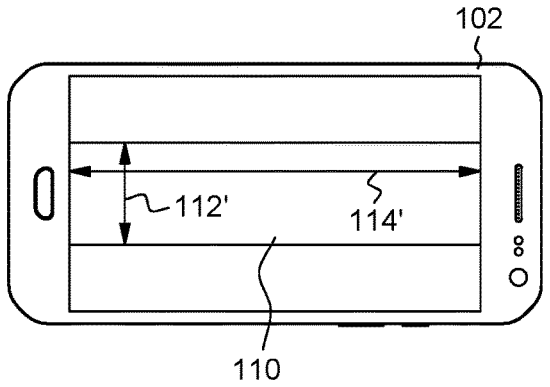

As noted above, one approach for fitting a digital object on a fixed-size display is to reduce the dimensions of the digital object enough to fit the longest dimension into the display, while maintaining the same aspect ratio. FIGS. 1A and 1B depict an example of proportionally shrinking a large digital object for display on a mobile device.

In FIG. 1A, mobile device 102 is shown as an example computer system having a physical display 104 with fixed physical display dimensions (height and width). Digital object 110, for display on the mobile device 102, is shown having first dimension 112 in a first (vertical) direction, and second dimension 114 in a second (horizontal) direction. It is seen that the digital object 110 is too large to fit in physical display 104 without shrinking the size of the digital object 110.

Consequently, as shown in FIG. 1B, a smaller version of digital object 110 is shown displayed in the physical display of mobile device 102. The size of digital object 110 was decreased proportionally, and the displayed version has dimensions 112' by 114' corresponding to original dimensions 112 and 114, respectively. Here, the dimensional or aspect ratio is been maintained—the ratio of dimension 112 to dimension 114 is the same as the ratio of dimension 112' to dimension 114'.

The size of digital object 110 has been significantly reduced to enable it to fit on physical display 104. Aspects described herein provide approaches by which a user can view a larger-dimension version of the digital object without compromising the display dimension in the manner illustrated in FIGS. 1A and 1B.

Figure 2B:
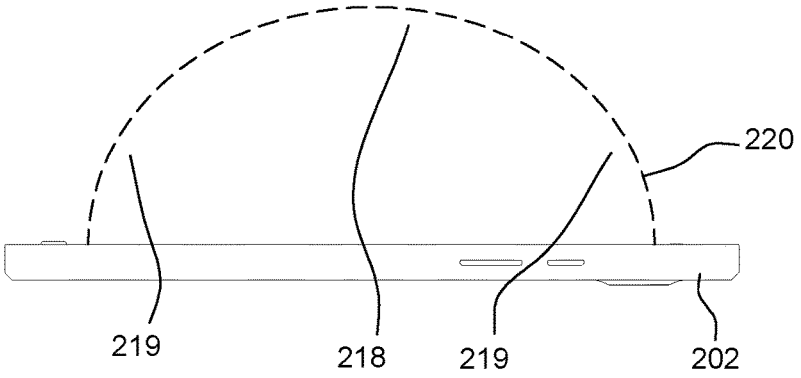
Figure 2C:
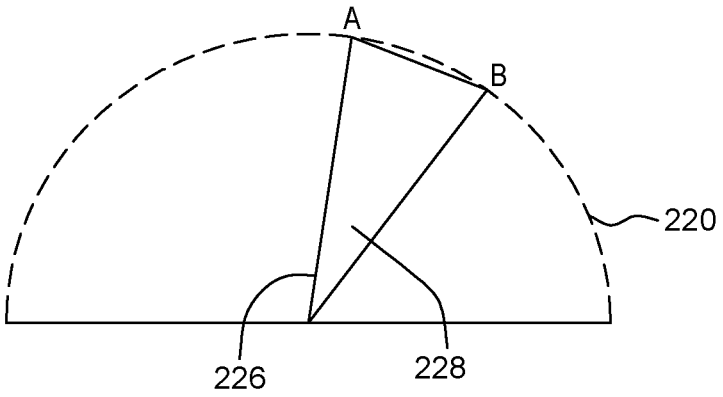

FIGS. 2A-2C depict an example of a curved virtual display surface established on a fixed-size physical display of a mobile device, in accordance with aspects described herein. Here, mobile 202 has established thereon a curved virtual display surface 220 having a curved dimension 222. Curved dimension 222 refers to the dimension, i.e. arc-length, of the curved virtual display surface. This dimension is tailored to accommodate a desired dimension of the digital content to be displayed. Below mobile device 202 is a depiction of a flattened version of curved virtual display surface 220. The curved virtual display surface has first dimension 112, which is the first (height) dimension of digital object 110 from FIG. 1A, 1B, and curved dimension 222 which is the same as dimension 114, the second (width) dimension of digital object 110 from FIGS. 1A and 1B. The curved dimension is long enough to accommodate the second dimension of the digital content, due to the curvature and associated distance scaling that occurs when something is depicted as lying on a curved surface. The height of the digital object fits into the height dimension of the mobile device as shown by the present of areas 224 in the upper corners of the physical display of mobile device 202. Therefore, curved virtual display surface 220 is large enough to depict the entirety of the digital object without reducing the dimension of digital object, and the curved character of the virtual display surface enables it to be displayed in the physical display of the mobile device. The digital object will be displayed in the curved virtual display surface, drawn on the flat (in this embodiment) physical display.

A result of displaying curved virtual display surface 220 is that additional areas 224 are present, which can be used for any desired content. This may be content that is associated with a digital object, context-specific content, or other content such as advertising, as examples.

FIG. 2B illustrates a top view of mobile device 202 illustrating the curvature characteristic and resulting depth of the curved virtual display surface 220 when displayed on the physical display 204 of the mobile device 202. Areas 219 indicate near-view areas of the curved virtual display surface—that is, areas where the depth of the virtual surface is shallower from the user's vantage point. Area 218 indicates a far-view area—that is, an area where the depth of the virtual surface is deeper from the user's vantage point.

Software of the device can determine the dimension of the fixed-size physical display and the dimensions of the digital object. If dimension(s) of the digital object exceed corresponding dimension(s) of the display, then software can consider dimension(s) of the digital object as a circular arc then calculate one or more radii of curvature. Based on dimension(s) of the digital object, for example a width dimension as in the second dimension of digital object 110 in FIGS. 1A and 1B, a circular arc is determined having one or more radii of curvature. This informs the curved characteristics of the virtual surface. In some examples, the virtual surface has a constant degree of curvature so it resembles a segment of a three-dimensional cylinder or sphere. In other examples, the virtual surface has varying degrees of curvature so it resembles a segment of an ellipsoid or another non-spherical curved three-dimensional shape.

Based on the radius/radii of curvature, software can determine near-view and far-view areas of the curved virtual display surface and accordingly alter content of the digital object in one or more areas that correspond (i.e. are to be shown at) to near-view and/or far-view area(s) of the curved virtual display surface. The alterations may be to shrink, enlarge, skew, or the like, content of the digital object to improve viewability of the digital content across the display surface and/or to reduce a curvature appearance of the digital object displayed in the curved virtual display surface, as examples. The adjustment may be an adjustment to the raw data for the display buffer, for instance interpolation or extrapolation of pixel data of an image of video. Additionally or alternatively, the adjustment may be more sophisticated, for instance when the particular content is identifiable as a digital construct (e.g. a letter of a particular font and size) and can be substituted with a variant, e.g. a larger size of that letter in the particular font.

In one approach, dimension or font size of near-view content will be remain the same or have relatively minimal adjustment applied thereto, whereas the dimension or font size of far-view content will be enlarged. In this manner, software can automatically alter the dimension or size to at least partially counteract the user's ability to see the depth created by the curved virtual display surface and differentiate depths between near-view and far-view content. As other examples, the size of near-view areas could be decreased, and/or alterations are applied to both near-view and far-view areas of the digital object.

FIG. 2C illustrates how trigonometry can be used to determine change of dimension and/or identify the curvature characteristics of the virtual display surface 220. The relative position of an area of the digital object (e.g. point A or B) from the user's viewpoint can be identified. Software can then alter the dimension of the area with respect to the near-view and/or far-view area distance using trigonometric equations. In this example, the curvature is constant with radius r, 226. The perimeter of the semi-circular curve is $(2\pi r)/2=\pi r$. The length of arc AB is therefore $\pi r*(\theta/180)$, where $\theta$ is the interior angle 228. The length of the segment AB is less than the length of arc AB. The length of the arc segment can be determined as above as can the actual dimension of the content to be displayed in area AB, for instance the letter "W" that spans length of segment AB, therefore the factor of enlargement of the content (e.g. the letter "W") can be determined as (length of arc AB/length of segment AB).

Figure 3A:
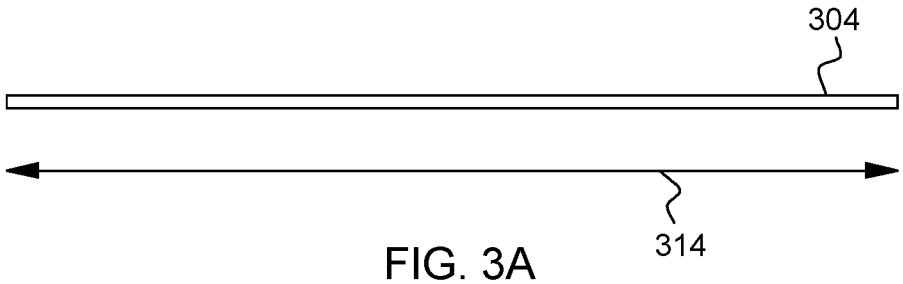
FIGS. 3A-3C illustrate an effect of applying curvature to a fixed-size physical display, and overcoming the effect with a curved virtual display surface, in accordance with aspects described herein.
Figure 3B:
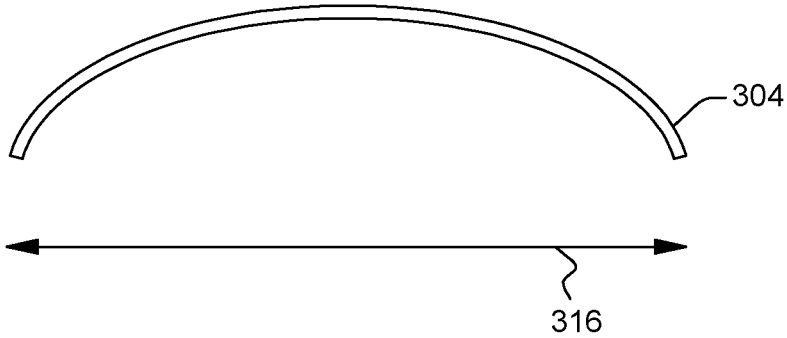

When a straight fixed-length object is bent or curved in one direction, the distance in that direction that the object spans decreases. FIGS. 3A and 3B illustrates this effect in the context of applying curvature to a fixed-size physical display. FIG. 3A depicts physical display 304 with length 314. 314 also corresponds to the distance spanned by physical display 304 in the unbent state. FIG. 3B illustrates physical display 304 with curvature applied thereto. The length of curved physical display 304 in FIG. 3B remains 314, however the distance spanned, 316, is smaller. That is, the edge-to-edge distance, 314 vs. 316, covered by the display is reduced when curvature is applied, despite the length of the display remaining constant. Greater curvature applied to the display results in a lesser edge-to-edge linear distance.

Figure 3C:
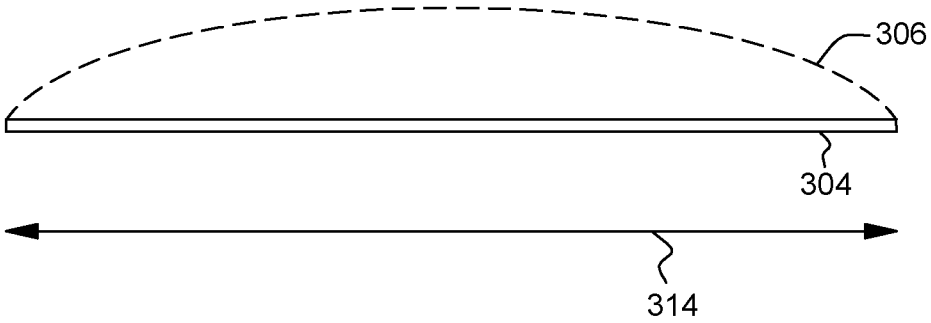

FIG. 3C overcomes this effect with a curved virtual display surface in accordance with aspects described herein. The edge-to-edge distance of virtual surface 306 matches that of length 314, the dimension of the physical display 304. The virtual surface has a curvature programmatically applied to create a circumference and provide a virtual depth of the surface. Accordingly, the circumference of the surface portion will be larger than the length 304 of the physical display.

Figure 4A:
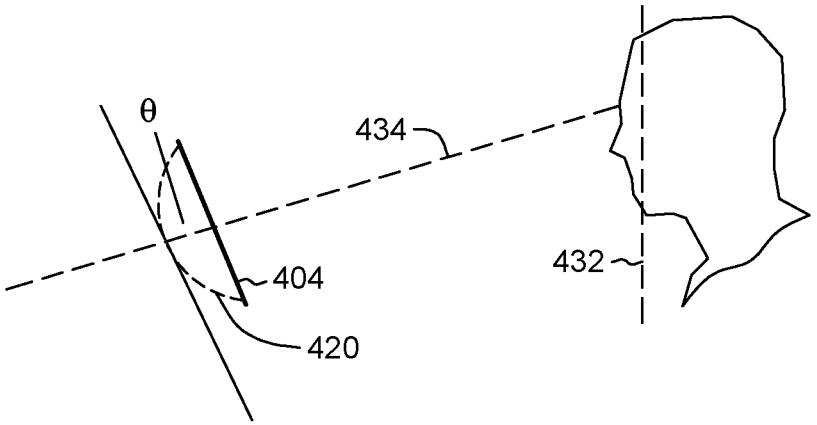
FIGS. 4A and 4B depict an example of applying an adjustment to a curvature of a curved virtual display surface based on tracking relative angular positions, in accordance with aspects described herein.
Figure 4B:
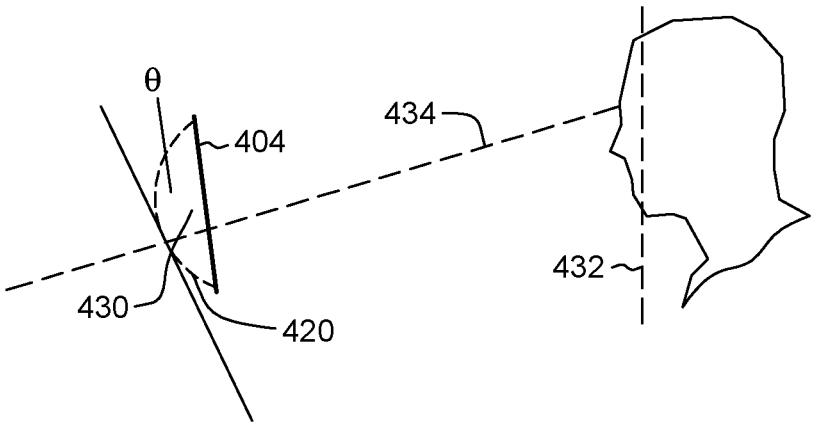

As described above, device(s) installed in the mobile device can track the relative angular positions among the facial plane of the user, a plane of the mobile device's physical display, and the eye direction (viewing direction) of the user. Software can automatically build a preferred angular position profile corresponding to the user based on user preferences and/or historical viewing patterns. The preferred angular position profile includes an indication of a viewing angle that the user prefers, the viewing angle being relative to the plane of the physical display and the facial plane of the user. This can be leveraged to provide an initial curved virtual display surface when the user selects to commence display of the digital object. Then, this initial curved virtual display surface can be adjusted with changes in the relative angular positions. FIGS. 4A and 4B depict an example of applying an adjustment to a curvature of a curved virtual display surface based on tracking relative angular positions, in accordance with aspects described herein.

In FIG. 4A, the user views physical display 404 with line of sight 434 and facial plane orientation 432, forming a viewing angle $\theta$. That angle also represents the angle at which the user views curved virtual display surface 420. In this example, the virtual surface has curvature applied in not only one direction—horizontal, exemplified in FIGS. 2A and 2B—but also the vertical direction as seen from the side view of the device in FIGS. 4A and 4B.

Tracking the relative angular positions enables the mobile device to adjust the curved virtual display surface where appropriate. If the orientation of the device's display plane and/or the user's facial plane changes with respect to the user's viewing direction, software installed in the device can rotate the virtual display surface in the polar axis of the virtual surface. In FIG. 4B, the orientation of the display plane has changed to be a more vertical orientation. This changes the viewing angle $\theta$ for the user if the curved virtual display surface is not modified. However, as shown in FIG. 4B, the adjustment (rotation, stretch, skew, etc.) of the curved virtual display surface can be done in such a way that the changed angular orientation of the physical display (in this example) will be compensated-for automatically by rotating the virtual display surface in its polar axis. The user will still view the same virtual display surface orientation with respect to the user's eye focus direction as the user previously had (i.e. the virtual display surface curvature will be adjusted to bring angle, θ, 430 in FIG. 4B back to θ in FIG. 4A). Thus, the change in angle observed can be automatically compensated-for by the rotation of the virtual display surface about its polar axis and/or other adjustments. This provides the user with the same virtual display orientation with respect to the user's eye focus direction as was used previously, prior to the observed change in the physical display plane or user's facial plane, maintaining the a viewing perspective of the user, provided by an initial curved virtual display surface, to the digital object.

The polar axis of the curved virtual display surface can shift depending on changes in angular orientation of the physical display, line of sight of the user, and other factors, such as if the user manually adjusts the polar axis and/or curvature of the display surface. In addition, a change in orientation of the polar axis of the curved virtual display surface can drive the automatic scaling and/or realignment of the content displayed based on the change to the polar axis. The virtual depth of the near and far-view objects and the curvature of the surface at those areas may change based on the shifted polar axis, in which case the alignment/scaling of the content in those areas and more generally in the entire surface may be adjusted, for instance to mimic the appearance of the content prior to the change to the polar axis and/or to scale and align the content in any other way desired.

The digital object may be provided as part of digital content, such as a document or other file. Contextual analysis of the digital content can be performed to trigger establishing the virtual display surface on the physical display at the appropriate time when the digital content is viewed or opened. By way of specific example, the digital content may be a document with a mixture of text and graphics. The document at load begins on page 1 with several pages of text. The user can scroll down and at some point reach a panoramic picture that is larger than the page size of the document. That point in the document can trigger establishment of a curved virtual display surface on the physical display of the viewing device in order to display the panoramic picture with lesser or no proportional downsizing than would be needed to fit the picture into the dimensions of the physical display.

Performing contextual analysis on the document can ascertain a point during presentation of the document at which the panoramic picture is to be displayed. As an example, the point may be a point that the user is to reach in scrolling down the document to view the panoramic picture. Based on the user commencing presentation of the document to view on the device, the curved virtual display surface to present that panoramic picture is initially absent from the physical display. Based on the user scrolling and reaching that point at which the panoramic picture is to display, this can invoke establishing the curved virtual display surface and displaying of the panoramic picture in the curved virtual display surface. The digital object may be displayed in the curved virtual display surface for some timeframe that may be dependent on the user's continued scrolling and/or on some predefined duration, as examples. An example such scenario is where the digital content is a video during which, at some point and for some duration, an object is to be presented in a virtual curved display surface in accordance with aspects described herein. The presented of the curved virtual display surface can be toggled depending on whether its functionality is desired given the portion of the content presently on the display. Outside of presenting that particular panoramic picture in the above example, the curved virtual display surface for displaying that digital object may be absent from the physical display during presentation of the digital content except during that timeframe during which the panoramic picture is to be displayed.

Figure 5:
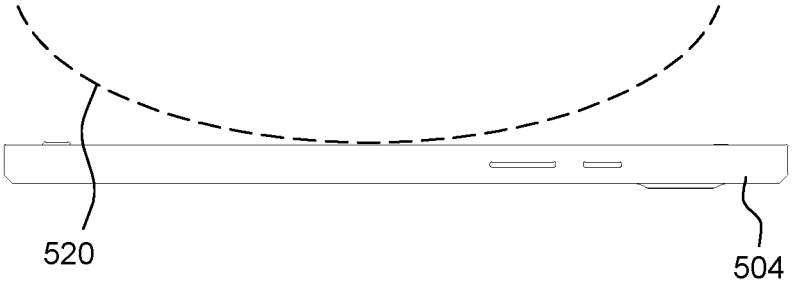
FIG. 5 depicts an example of a convex-type virtual display surface, in accordance with aspects described herein.

While the examples depicted in several figures and described above are presented with a concave curvature relative to the surface of the physical display, aspects described herein can also be applied for convex curvature curved virtual display surfaces like that shown in FIG. 5. Convexity is shown with an analog of FIG. 2B showing physical display 504 except that the curved virtual display surface 530 is convex with an edge-to-edge distance being equal to the length of the physical display 504. The principles described above with respect to curvature calculation logic apply to the convex case. In some situations, it may be desired to employ a convex display surface depending on the extent of the modifications to apply to the object in the different near and far-view areas of the display. In either case (convex or concave, or perhaps a combination of the two across the width of the virtual display surface), the dimension/font sizes of near-view areas can be kept substantially the same as their size in the original digital object, while the dimension/font sizes of the far-view areas can be altered, for instance so that the curvature appearance is reduced and the user is unable or less able to differentiate depths between near-view and far-view areas. The user instead may view them as being of the same dimension.

Figure 6:
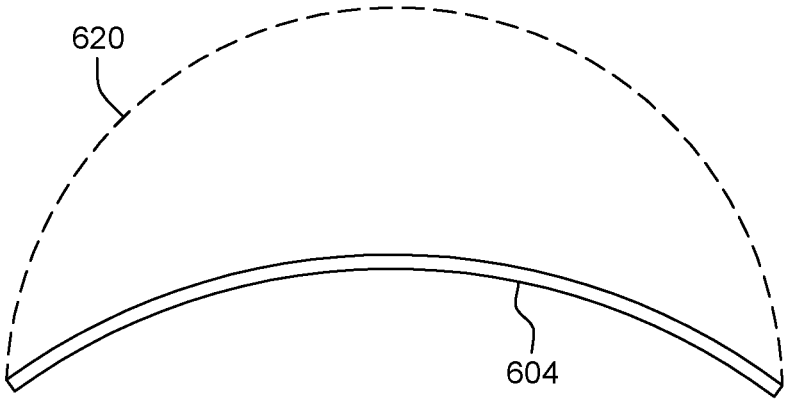
FIG. 6 depicts an example of a curved virtual display surface established on a curved physical display, in accordance with aspects described herein.

Aspects described herein can also be used in conjunction with physical displays that themselves are bendable/flexible. The curvature of the virtual display surface may be based at least in part on curvature of the physical display. FIG. 6 depicts an example of a curved virtual display surface established on a curved physical display, in accordance with aspects described herein. Here, physical display 604 is a curved display, such as a curved television, computer monitor, or mobile device display as examples. The curved virtual display surface 620 is provided with a greater curvature, and therefore longer curved dimension than a curved dimension of physical display 604. The extent to which the curved physical display is flexed may affect the curvature applied to the curved virtual display surface and the alterations applied to the areas of the digital object corresponding to near-view and far-view areas of the virtual display surface.

Figure 7:
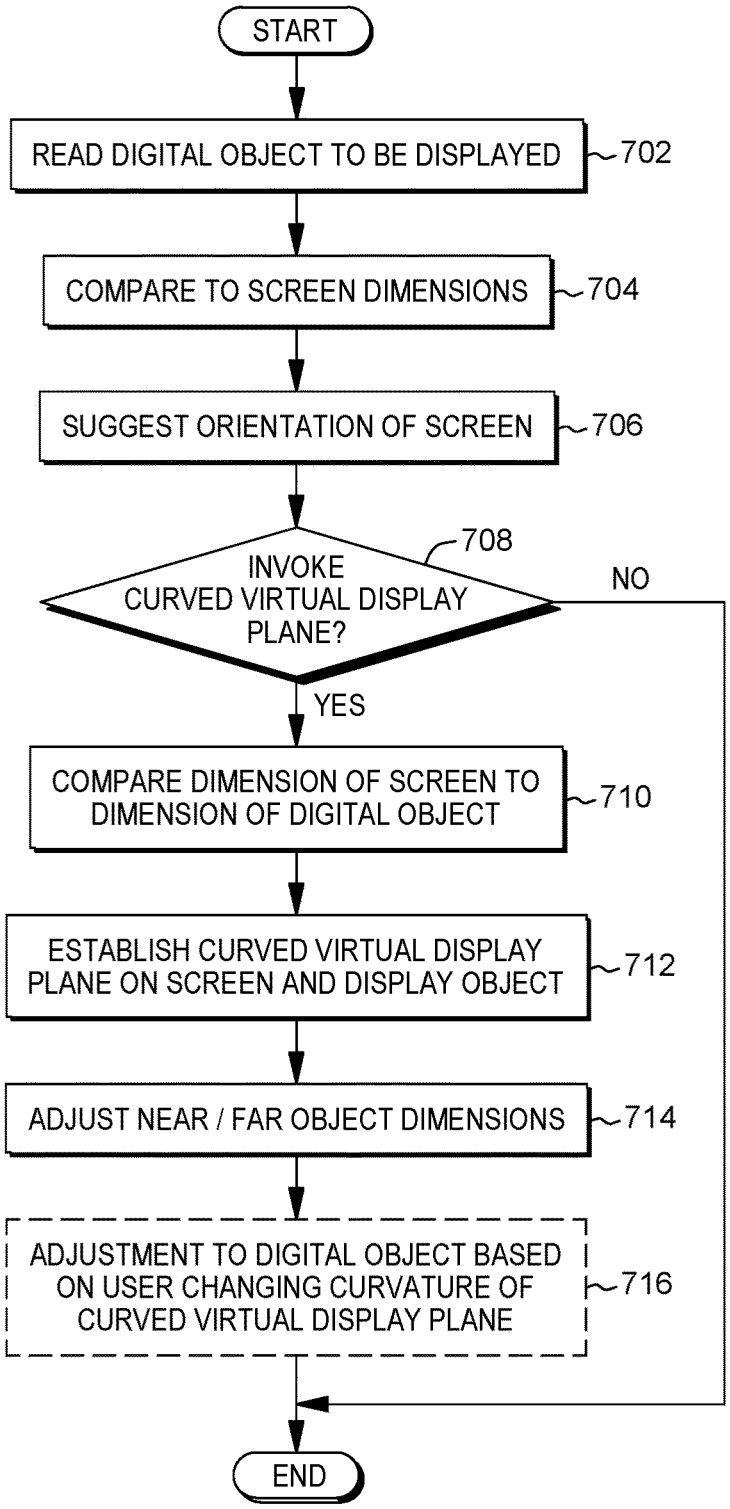
FIG. 7 depicts one example of a process for providing a curved virtual display surface on a physical display, in accordance with aspects described herein.

FIG. 7 depicts one example of a process for providing a curved virtual display surface on a physical display, in accordance with aspects described herein. The process may be performed by a computer system having, using, or being in communication with the physical display, as examples. Initially, the process reads the digital object to be displayed and determines its dimensions (length and width) (702). These dimensions are compared to the screen dimensions of the physical display (704), which may be gathered based on the configuration of the computer system for instance. The process then suggests an orientation (e.g. horizontal or vertical) to use to display the digital object (706) and the user can rotate the device to the suggested orientation if necessary.

The process then determines whether to invoke the curved virtual display surface (708). If the dimensions of the digital object enable it to fit without adjustment on the physical display, then the curved virtual display surface is not necessary and the process ends.

Otherwise, if the software finds that digital object dimension(s) will be reduced or cannot be accommodated in the physical display area without reducing the digital object dimension(s) to some minimum extent necessary to trigger the curved virtual display surface, then the curved virtual display surface will be invoked. In this case, the process continues by comparing dimension(s) of the physical display to dimension(s) of the digital object (710). The curvature and length of the virtual display surface is tailored according to the length needed in order to keep the version of the digital object displayed on the curved virtual surface in proportion to the original full-size digital object. The digital object displayed on the curved virtual display surface may be original size or may be scaled down proportionally, though to a lesser extent than the scaling shown in the approach of FIGS. 1A and 1B.

After determining the characteristics of the virtual display surface, the process establishes the curved virtual display surface on the screen and displays in the curved virtual display surface the digital object (712).

Based on the current shape of the virtual display surface, the process identifies the near and far object/fonts dimensions of areas of the digital object and accordingly applies adjustments (714) to re-adjust the dimensions.

At some point, the user can, if the functionality is provided, cause a change to the curvature of the curved virtual display surface, in which case the process makes an adjustment to the curved virtual display surface (716).

Processes are described herein for providing a curved virtual display surface for displaying a digital object. Further examples are provided with reference to FIGS. 8A and 8B. The processes may be performed by a computer system having, using, or being in communication with the physical display, as examples. The process of FIG. 8A begins by identifying dimensions of a digital object (802). The digital object is for display on a physical display of a computer system, the physical display having fixed display dimensions. In some examples, the identified dimensions of the digital object include an identified first dimension and an identified second dimension, and the fixed display dimensions of the physical display include a first dimension in a first direction and a second dimension in a second direction perpendicular to the first direction.

The process continues by determining whether the identified dimensions of the digital object exceed the physical display dimensions of the physical display (804). In one example, it is determined whether the digital object can fit within the physical display in the flat display plane thereof without resizing the digital object at all, or without resizing the object more than some threshold. For instance it may be determined whether displaying the digital object on the physical display while maintaining a ratio between the identified first dimension of the digital object and the identified second dimension of the digital object would result in a dimension, in one direction, of the digital object so displayed being greater than a dimension of the physical display in the one direction. For instance, a panoramic image may fit vertically in the flat display plane of the physical display but not horizontally without adjusting the aspect ratio of the image.

If the digital object fits within the physical display without resizing or without resizing more than the threshold, then the object is displayed (806) in its full size or scaled to fit the physical display, and the process ends.

Otherwise, based on determining at (804) that displaying the digital object would result in the dimension, in the one direction, of the digital object being greater than the dimension of the physical display in the one direction, the process determines a curved dimension (808) for a curved virtual display surface to be provided. The curved dimension may be determined such that the curved dimension accommodates the greater dimension, in the one direction, of the digital object while maintaining the ratio between the identified first dimension of the digital object and the identified second dimension of the digital object. Using the panoramic image example, the curved dimension may be determined to be the horizontal width of the panoramic image. Based on that determined curved dimension, at least one radius of curvature is determined (810) for the curved virtual display surface to provide that curved dimension for the curved virtual display surface. In other words, the radius/radii of curvature to implement the curved virtual display surface with the curved dimension needed, while fitting within the width of the physical display, are determined.

Based on the above, which includes the identified dimensions of the digital object, the process establishes on the physical display the curved virtual display surface for displaying the digital object (812). As noted, the curved virtual display surface has a first dimension corresponding to the first dimension of the digital object (e.g. vertical dimension) and to the first direction (e.g. vertical direction of the physical display) and has a curved dimension corresponding to the second dimension of the digital object (e.g. horizontal dimension) and the second direction (e.g. horizontal direction of the physical display). The curved dimension of the curved virtual display surface is greater than the second dimension (e.g. horizontal dimension) of the physical display.

The curved virtual display surface is therefore curved relative to the surface of the physical display. In examples, the curved virtual display surface has a concave curvature, a convex curvature, or a mix of concave curvature and convex curvature, relative to a viewing direction of a user viewing the physical display. Additionally or alternatively, the physical display may include a flexible display having a curve profile, wherein the curved virtual display surface has a different curve profile than the curve profile of the flexible display.

The digital object is then displayed in the established curved virtual display surface (814). A ratio between the identified first dimension of the digital object and the identified second dimension of the digital object, e.g. the aspect ratio, may be maintained in displaying the digital object on the curved virtual display surface. For instance, the digital object may not have been resized, or if it was resized, it may have been done without modifying the proportions of the object.

As part of displaying the digital object in the curved virtual display surface, the process may determine based on the at least one radius of curvature one or more near-view areas of the curved virtual display surface and one or more far-view areas of the curved virtual display surface. It may then alter content in one or more areas of the digital object displayed in the curved virtual display surface, the one or more areas corresponding to at least one area of the one or more near-view areas and the one or more far-view areas. The altering can include resizing, scaling, and/or aligning content in each area of the one or more areas of the digital object displayed in the curved virtual display surface. In some examples, the alteration is to at least partially reduce a curvature appearance of the digital object displayed in the curved virtual display surface. The content in at least one area of the one or more areas of the digital object displayed in the curved virtual display surface may include text having a font size, in which case the resizing can include changing a font size of the text.

Additionally or alternatively, the resizing includes (i) decreasing size of content in at least one area of the digital object corresponding to the one or more near-view areas of the curved virtual display surface, or (ii) increasing size of content in at least one area of the digital object corresponding to the one or more far-view areas of the curved virtual display surface, or a combination of (i) and (ii).

Figure 8A:
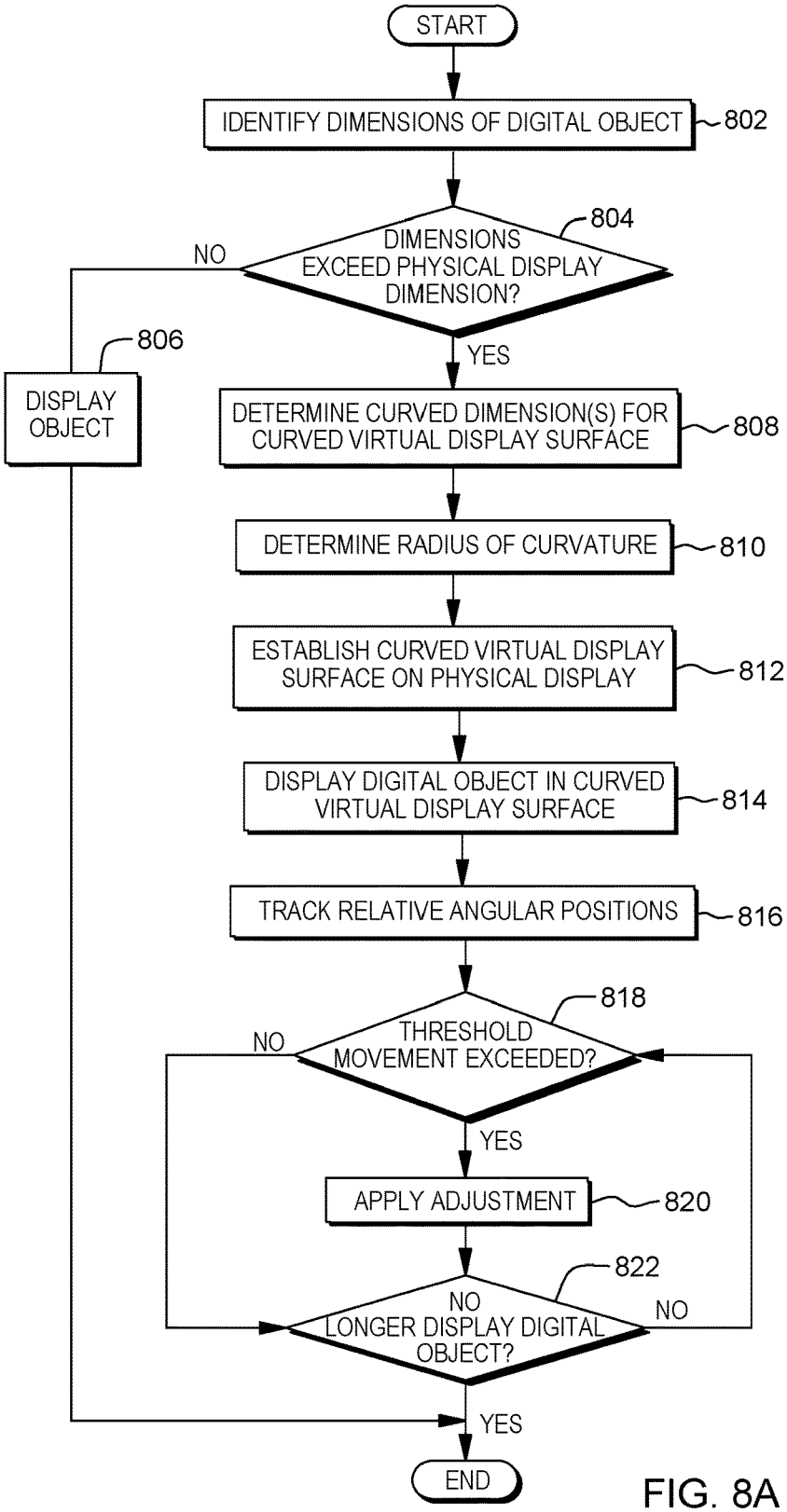
FIGS. 8A and 8B depict example processes for providing a curved virtual display surface for displaying a digital object, in accordance with aspects described herein.

As an enhancement, the established curved virtual display surface can include an initial curved virtual display surface, and the process as shown in FIG. 8A further includes tracking relative angular positions between a facial plane of a user, a plane of the physical display, and a viewing angle of the user, and determining whether a big enough change (i.e. exceeds a threshold) is detected (818). Based on detecting a big enough change in the relative angular positions, an adjustment is applied (820) to a curvature of the initial curved virtual display surface to provide an adjusted curved virtual display surface that maintains a viewing perspective, of the user, that was provided by the initial curved virtual display surface, to the digital object. As a particular example, a preferred angular position profile is built for a user based on preferences or historical viewing patterns of the user in viewing digital objects. The preferred angular position profile can include an indication of a preferred viewing angle relative to the plane of the physical display and the facial plane of the user. That is, it can be determined based on context what position the user prefers in terms of the line of sight to the device. When a digital object is loaded for presentation, the curvature of the initial curved virtual display surface is set to provide the preferred viewing angle upon commencing display of that digital object in the initial curved virtual display surface. If the angularity changes based on user movement for instance, then the adjustment (i.e. 820) is made. Then, or if instead at (818) no significant movement was detected, the process continues by determining whether to no longer display the digital object (822). As examples, the user may close the application displaying the object or may scroll or switch away from the object. If the digital object is to remain displayed (822, N), the process loops back to (818) as part of monitoring for angularity changes, otherwise (822, Y) the process ends.

Additionally or alternatively, the curved virtual display surface can conform to a curvature with a corresponding polar axis. Based on a change in orientation of the polar axis (for example the user changes the curvature, or the curvature changes based on changing orientation of the physical display or the user's line or sight, as examples), content being displayed in the curved virtual display surface (with the changed polar axis), such as the content in the one or more areas of the digital object can be automatically scaled and/or realigned, for instance to preserve the initial appearance of the content and/or to conform to any desired scaling/alignment/presentation of the content.

Figure 8B:
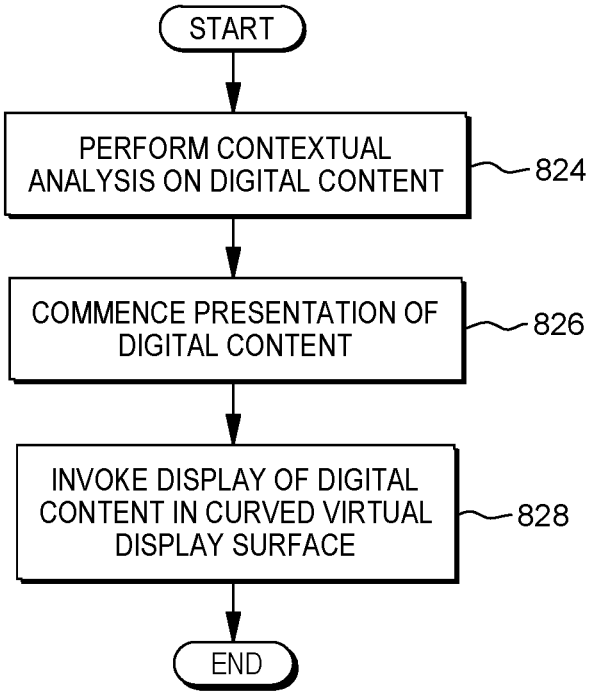

FIG. 8B depicts an example in which the digital object is provided as part of digital content for viewing on the physical display. The digital content may be, as one example, a document with text paragraphs and the digital object embedded between text paragraphs. In another example, the digital content is a media file such as a video containing the digital object, which digital object is different dimensions or is to be presented in difference dimensions than other portions of the video.

In these cases, the curved virtual display surface is not necessarily needed for the entirety of the digital content. It instead may be invoked when needed, i.e. when the digital object is up for displaying.

Accordingly, the process of FIG. 8B performs contextual analysis on the digital content to ascertain a point during presentation of the digital content (a scroll point, a time of the video, etc.) at which the digital object is to be displayed (824). Presentation of the digital content is commenced for viewing the digital content on the physical display (826). Eventually, based on reaching the point during presentation of the digital content at which the digital object is to be displayed, the process invokes the displaying of the digital object in the curved virtual display surface (828). In some examples, some aspects of FIG. 8A (e.g. 802, 804, 808, 810) are performed prior to invoking the curved virtual display surface, and some aspects (812, 814, 816, 818, 820, 822) are performed when invoking the displaying (828) and thereafter. When the digital object is finished displaying, the presentation of the digital content may switch back to using the flat physical display plane. Thus, the digital object may be displayed in the curved virtual display surface for a timeframe during presentation of the digital content, where the curved virtual display surface for displaying the digital object is absent from the physical display during presentation of the digital content except during that timeframe.

Processes described herein may be performed singly or collectively by one or more computer systems, such as computer system(s) described below with reference to FIG. 9. Such a computer system may have, use, or be in communication with the physical display on which the curved virtual display surface is presented, as examples.

Figure 9:
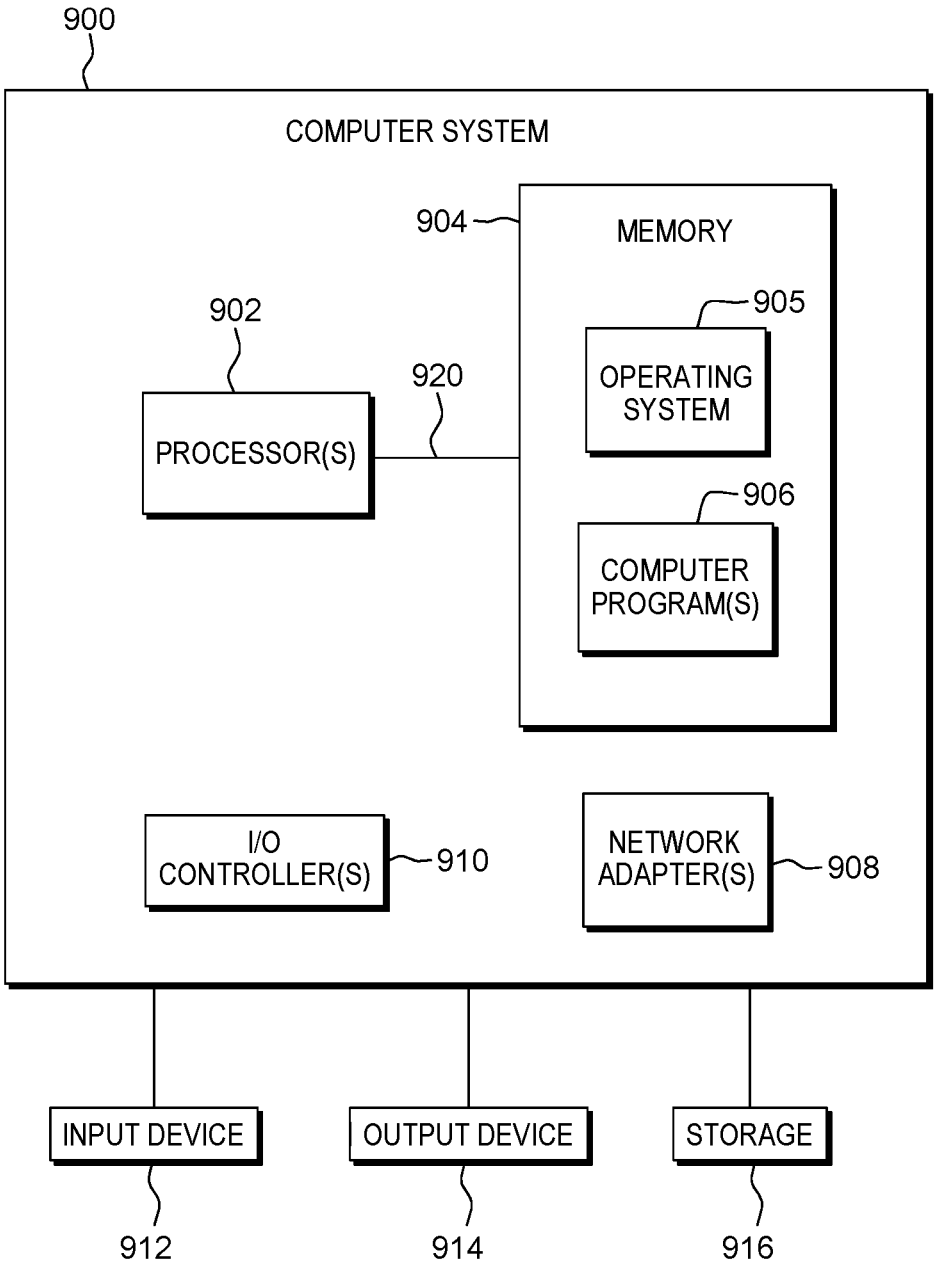
FIG. 9 depicts an example of a computer system to incorporate or use aspects described herein.

FIG. 9 depicts one example of a computer system to incorporate and use aspects described herein. A computer system may also be referred to herein as a processing device/system or computing device/system, or simply a computer. Computer system 900 may be based on one or more of various system architectures such as those offered by International Business Machines Corporation (Armonk, N.Y., USA) or Intel Corporation (Santa Clara, Calif., USA), as examples.

Computer system 900 is suitable for storing and/or executing program code and includes at least one processor 902 coupled directly or indirectly to memory 904 through, e.g., a system bus 920. In operation, processor(s) 902 obtain from memory 904 one or more instructions for execution by the processors. Memory 904 may include local memory employed during actual execution of the program code, bulk storage, and cache memories which provide temporary storage of at least some program code in order to reduce the number of times code must be retrieved from bulk storage during program code execution. A non-limiting list of examples of memory 904 includes a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Memory 904 includes an operating system 905 and one or more computer programs 906, for instance programs to perform aspects described herein.

Input/Output (I/O) devices 912, 914 (including but not limited to displays, microphones, speakers, accelerometers, gyroscopes, magnetometers, light sensors, proximity sensors, GPS devices, cameras, etc.) may be coupled to the system either directly or through I/O controllers 910.

Network adapter(s) 908 may also be coupled to the system to enable the computer system to become coupled to other computer systems, storage devices, or the like through intervening private or public networks. Ethernet-based (such as Wi-Fi) interfaces and Bluetooth® adapters are just examples of the currently available types of network adapters 908 used in computer systems.

Computer system 900 may be coupled to storage 916 (e.g., a non-volatile storage area, such as magnetic disk drives, optical disk drives, a tape drive, etc.), having one or more databases. Storage 916 may include an internal storage device or an attached or network accessible storage. Computer programs in storage 916 may be loaded into memory 904 and executed by a processor 902 in a manner known in the art.

The computer system 900 may include fewer components than illustrated, additional components not illustrated herein, or some combination of the components illustrated and additional components. Computer system 900 may include any computing device known in the art, such as a mainframe, server, personal computer, workstation, laptop, handheld or mobile computer, tablet, wearable device, telephony device, network appliance (such as an edge appliance), virtualization device, storage controller, etc.

Figure 10:
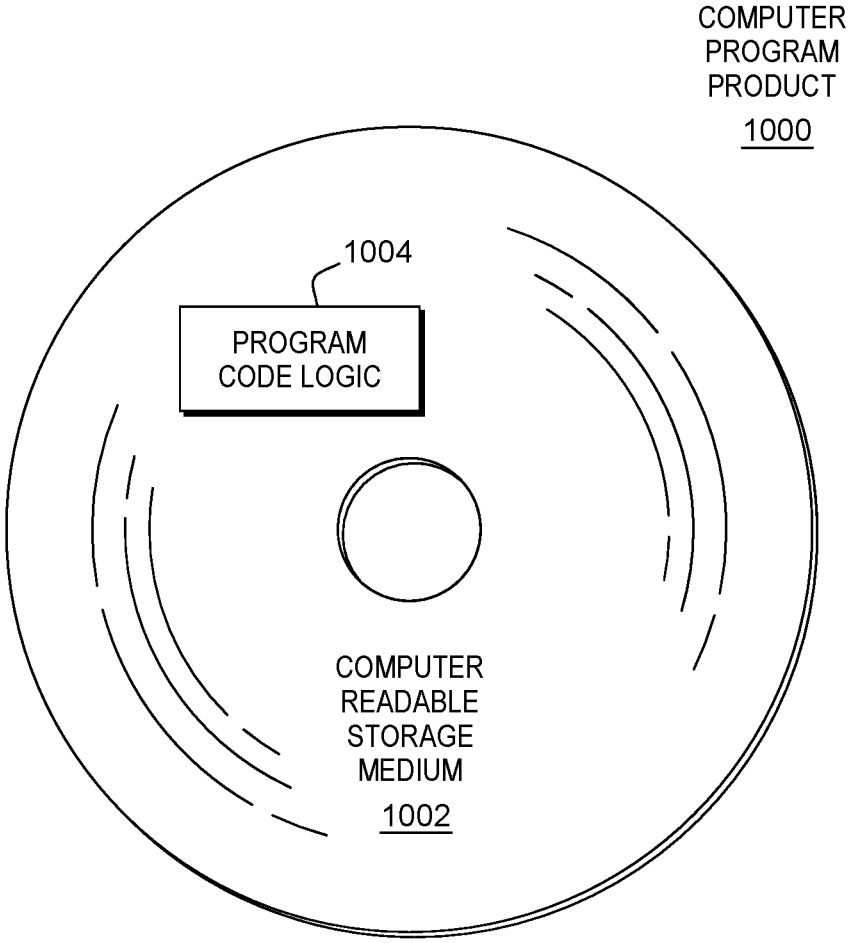
FIG. 10 depicts one embodiment of a computer program product.

Referring to FIG. 10, in one example, a computer program product 1000 includes, for instance, one or more computer readable storage media 1002 to store computer readable program code means, logic and/or instructions 1004 thereon to provide and facilitate one or more embodiments.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A computer-implemented method comprising:

identifying dimensions of a digital object, of digital content digitally stored in a file of a computer system, for display on a physical display of a computer system, the physical display comprising fixed display dimensions;

establishing on the physical display a curved virtual display surface for displaying the digital object, the curved virtual display surface having a programmatically-applied surface curvature determined based at least in part on the identified dimensions of the digital object, wherein the physical display has a surface curvature that is different from the surface curvature of the curved virtual display surface, and wherein the established curved virtual display surface comprises an initial curved virtual display surface;

displaying the digital object in the initial curved virtual display surface;

tracking relative angular positions between a facial plane of a user, a plane of the physical display, and a viewing angle of the user; and based on detecting a change in the relative angular positions, applying an adjustment to a curvature of the initial curved virtual display surface to provide an adjusted curved virtual display surface that maintains a viewing perspective of the user, provided by the initial curved virtual display surface, to the digital object.

2. The method of claim 1, wherein the fixed display dimensions of the physical display comprise a first dimension in a first direction and a second dimension in a second direction perpendicular to the first direction, wherein a ratio between an identified first dimension of the digital object and an identified second dimension of the digital object is maintained in displaying the digital object in the initial curved virtual display surface, wherein the initial curved virtual display surface has a first dimension corresponding to the first dimension of the digital object and to the first direction and has a curved dimension corresponding to the second dimension of the digital object and the second direction, wherein the curved dimension of the initial curved virtual display surface is greater than the second dimension of the physical display.

3. The method of claim 1, wherein the identified dimensions of the digital object comprise a first dimension and a second dimension, and wherein the method further comprises:

determining whether displaying the digital object on the physical display while maintaining a ratio between the identified first dimension of the digital object and the identified second dimension of the digital object would result in a dimension, in one direction, of the digital object so displayed being greater than a dimension of the physical display in the one direction;

based on determining that displaying the digital object would result in the dimension, in the one direction, of the digital object being greater than the dimension of the physical display in the one direction, determining a curved dimension for the curved virtual display surface such that the curved dimension accommodates the greater dimension, in the one direction, of the digital object while maintaining the ratio between the identified first dimension of the digital object and the identified second dimension of the digital object; and determining, based on the determined curved dimension, at least one radius of curvature for the initial curved virtual display surface to provide the curved dimension for the initial curved virtual display surface.

4. The method of claim 3, wherein the displaying comprises:

determining based on the at least one radius of curvature one or more near-view areas of the initial curved virtual display surface and one or more far-view areas of the initial curved virtual display surface; and altering content in one or more areas of the digital object displayed in the initial curved virtual display surface, the one or more areas corresponding to at least one area of the one or more near-view areas and the one or more far-view areas.

5. The method of claim 4, wherein the altering comprises resizing content in each area of the one or more areas of the digital object displayed in the initial curved virtual display surface to at least partially reduce a curvature appearance of the digital object displayed in the initial curved virtual display surface.

6. The method of claim 5, wherein the content in at least one area of the one or more areas of the digital object displayed in the initial curved virtual display surface comprises text having a font size, and wherein the resizing comprises changing a font size of the text.

7. The method of claim 5, wherein the resizing comprises at least one selected from the group consisting of: (i) decreasing size of content in at least one area of the digital object corresponding to the one or more near-view areas of the initial curved virtual display surface, and (ii) increasing size of content in at least one area of the digital object corresponding to the one or more far-view areas of the initial curved virtual display surface.

8. The method of claim 4, wherein the initial curved virtual display surface conforms to a curvature with a corresponding polar axis, and wherein the method further comprises, based on a change in orientation of the polar axis, automatically scaling or realigning the content in the one or more areas of the digital object.

9. The method of claim 1, further comprising building a preferred angular position profile corresponding to the user and based on preferences or historical viewing patterns of the user, the preferred angular position profile comprising an indication of a preferred viewing angle relative to the plane of the physical display and the facial plane of the user, and wherein the curvature of the initial curved virtual display surface is set to provide the preferred viewing angle upon commencing display of the digital object in the initial curved virtual display surface.

10. The method of claim 1, wherein the digital object is provided as part of the digital content for viewing on the physical display, wherein the method further comprises:

performing contextual analysis on the digital content to ascertain a point during presentation of the digital content at which the digital object is to be displayed;

commencing presentation of the digital content for viewing on the physical display; and based on reaching the point during presentation of the digital content at which the digital object is to be displayed, invoking the displaying of the digital object in the initial curved virtual display surface, wherein the digital object is displayed in the initial curved virtual display surface for a timeframe during presentation of the digital content, and wherein the initial curved virtual display surface for displaying the digital object is absent from the physical display during presentation of the digital content except during the timeframe.

11. The method of claim 1, wherein the initial curved virtual display surface comprises a concave curvature or a convex curvature relative to a viewing direction of a user viewing the physical display.

12. The method of claim 1, wherein the physical display comprises a flexible display having a curve profile, and wherein the initial curved virtual display surface has a different curve profile than the curve profile of the flexible display.

13. The method of claim 1, wherein the surface curvature of the physical display is such that the physical display is flat or is curved.

14. A computer program product comprising:

a non-transitory computer readable storage medium readable by a processing circuit and storing instructions for execution by the processing circuit for performing a method comprising:

identifying dimensions of a digital object, of digital content digitally stored in a file of a computer system, for display on a physical display of a computer system, the physical display comprising fixed display dimensions;

establishing on the physical display a curved virtual display surface for displaying the digital object, the curved virtual display surface having a programmatically-applied surface curvature determined based at least in part on the identified dimensions of the digital object, wherein the physical display has a surface curvature that is different from the surface curvature of the curved virtual display surface, and wherein the established curved virtual display surface comprises an initial curved virtual display surface;

displaying the digital object in the initial curved virtual display surface;

tracking relative annular positions between a facial plane of a user, a plane of the physical display, and a viewing angle of the user; and based on detecting a change in the relative angular positions, applying an adjustment to a curvature of the initial curved virtual display surface to provide an adjusted curved virtual display surface that maintains a viewing perspective of the user, provided by the initial curved virtual display surface, to the digital object.

15. The computer program product of claim 14, wherein the displaying comprises:

determining one or more near-view areas of the initial curved virtual display surface and one or more far-view areas of the initial curved virtual display surface; and altering content in one or more areas of the digital object displayed in the initial curved virtual display surface, the one or more areas corresponding to at least one area of the one or more near-view areas and the one or more far-view areas.

16. A computer system comprising:

a memory; and a processor in communication with the memory, wherein the computer system is configured to perform a method, the method comprising:

identifying dimensions of a digital object, of digital content digitally stored in a file of a computer system, for display on a physical display of a computer system, the physical display comprising fixed display dimensions;

based on the identified dimensions of the digital object, establishing on the physical display a curved virtual display surface for displaying the digital object, the curved virtual display surface having a programmatically-applied surface curvature determined based at least in part on the identified dimensions of the digital object, wherein the physical display has a surface curvature that is different from the surface curvature of the curved virtual display surface, and wherein the established curved virtual display comprises an initial curved virtual display surface;

displaying the digital object in the initial curved virtual display surface;

tracking relative angular positions between a facial plane of a user, a plane of the physical display, and a viewing angle of the user, and based on detecting a change in the relative angular positions, applying an adjustment to a curvature of the initial curved virtual display surface to provide an adjusted curved virtual display surface that maintains a viewing perspective of the user; provided by the initial curved virtual display surface, to the digital object.

17. The computer system of claim 16, wherein the displaying comprises:

determining one or more near-view areas of the initial curved virtual display surface and one or more far-view areas of the initial curved virtual display surface; and altering content in one or more areas of the digital object displayed in the initial curved virtual display surface, the one or more areas corresponding to at least one area of the one or more near-view areas and the one or more far-view areas.

* * * * *